United States Patent [19]

Dix

[11] 4,110,173

[45] Aug. 29, 1978

[54] SEALING CLOSURE FOR AN OPENING OF A COKING OVEN

[75] Inventor: Kürt Dix, Bochum, Fed. Rep. of Germany

[73] Assignee: G. Wolf Jr. Kommanditgesellschaft, Bochum-Linden, Fed. Rep. of Germany

[21] Appl. No.: 759,852

[22] Filed: Jan. 17, 1977

[30] Foreign Application Priority Data

Jan. 19, 1976 [DE] Fed. Rep. of Germany ..... 2601707

[51] Int. Cl.[2] ..... C10B 25/06; C10B 25/16

[52] U.S. Cl. ..... 202/248; 202/269; 220/378; 34/242

[58] Field of Search ..... 202/242, 248, 269; 34/242; 220/228, 378

[56] References Cited

U.S. PATENT DOCUMENTS

| | | | |
|---|---|---|---|
| 2,085,775 | 7/1937 | Van Ackeren | 202/248 |
| 2,662,053 | 12/1953 | Brown | 202/269 |
| 2,744,858 | 5/1956 | Homan | 202/269 |
| 2,778,785 | 1/1957 | Otto | 202/248 |
| 3,172,825 | 3/1965 | Maloney | 202/248 |
| 3,705,087 | 12/1972 | Grumm et al. | 202/248 |
| 3,876,502 | 4/1975 | Dix et al. | 202/248 |
| 4,016,046 | 4/1977 | Van Ackeren et al. | 202/269 |
| 4,028,193 | 6/1977 | Nagayoshi | 202/269 |
| 4,033,827 | 7/1977 | White | 202/248 |
| 4,036,702 | 7/1977 | Nagayoshi | 202/248 |

FOREIGN PATENT DOCUMENTS

| | | | |
|---|---|---|---|
| 463,262 | 3/1937 | United Kingdom | 202/248 |

*Primary Examiner*—Morris O. Wolk
*Assistant Examiner*—Bradley Garris
*Attorney, Agent, or Firm*—Michael J. Striker

[57] ABSTRACT

A sealing closure for an opening of a coking oven includes a frame mounted on the coking oven about the opening, a door receivable in the frame with a clearance therefrom in a closing position, and an arrangement for sealing the clearance. The sealing arrangement consists of a sealing member including a rigid support element and a sealing element of a resiliently yieldable material mounted on a marginal portion of the support element and adapted to sealingly contact a contact surface of the frame in the closing position of the door. The support element is connected to the door for an adjustment of the position thereof, and is retained in a selected adjusted position. A marginal portion of the support element is received in an elongated recess and has longitudinally distributed projections which are accommodated in a plurality of cutouts in the sealing element, the cutouts extending from the recess to a sealing surface contacting the contact surface of the frame. The projections have dovetail shapes and project from the remainder of the support element to a distance which is smaller than the corresponding dimension of the respective cutout. The frame may include an inner frame member, and an outer frame member provided with the contact surface and mounted on the inner frame member, being separated therefrom by a heat insulation. The outer frame member may have a width corresponding to that of the contact surface, and a thickness which is substantially smaller than that of the inner frame member. The inner frame member may have a stepped ridge between the opening and the outer frame member, and the door may be configurated complementarily to the ridge. At least one groove may be provided on the frame, and the door may have a projecting bulge extending into the groove in the closing projection of the door to define a labyrinthine passage therewith. A resilient sheet member may be removably interposed between the door and the frame.

30 Claims, 12 Drawing Figures

SEALING CLOSURE FOR AN OPENING OF A COKING OVEN

BACKGROUND OF THE INVENTION

The present invention relates to a sealing closure for coking ovens in general, and more particularly to a sealing closure for a horizontal coking oven.

A wide variety of coking ovens of different constructions is already in operation or is being currently constructed. Such conventional coking ovens include walls which define a coking chamber, at least one charging and/or discharging opening being provided in at least one of such walls for communicating the exterior of the coking oven with the coking chamber. Depending on the particular construction of the coking oven, there have been already proposed various closures for closing the opening of the coking chamber during the operation of the coking oven.

It has already been proposed to so construct the closure that it includes a frame mounted on the coking oven so as to surround at least an outwardly open end of the opening, and to provide a contact surface on the frame. Then, a door may be received in the open end of the opening and mounted on the frame with a clearance between the frame and the door. To prevent or at least reduce the danger of escape of noxious gases from the coking chamber into the ambient atmosphere through the clearance between the door and the frame, it has also been proposed to provide a sealing arrangement which is mounted on the door and contacts the contact surface of the frame in the closing position of the door. Such a sealing arrangement then seals the clearance and prevents the abovementioned escape of gases.

The sealing arrangement of the conventional closure may include a strip-shaped sealing member which is frictionally retained on the door for adjustment of its position relative to the door and toward the contact surface of the frame in the closing position of the door, and being arrestable in any adjusted position thereof relative to the door. The sealing member may converge in direction to the contact surface to constitute a sealing edge thereat. It has also been already proposed to construct the sealing member as a sealing frame mounted on the door.

Experience with these conventional coking ovens and closures therefor has shown that, during the operation of the coking oven, the frame and the door deform as a result of temperature differentials between the various regions thereof. Inasmuch as the coking process performed in the coking chamber results in time-dependent and location-dependent changes in the temperature of the charge being coked, the end result is that various regions of the frame and of the door will achieve different temperatures, depending on their location relative to the charge, on the one hand, and on the progress of the coking operation, on the other hand. This results in a situation where, despite the fact that the sealing edges of the support member may have been originally brought in sealing contact with the contact surface of the frame, prior to the commencement of the coking operation, the sealing edges will disociate themselves from the contact surface during the operation of the coking oven and thus their sealing effect is at least impaired, if not annihilated.

To avoid this drawback of the conventional closures, it has also already been proposed to restore the sealing effect of the sealing arrangement by directing impacts against the side of the sealing member which faces away from the contact surface in the regions where the sealing edges have dissociated themselves from the contact surface, so that the sealing member, which is frictionally retained on the door, is adjusted in its position in direction toward the contact surface and thus the sealing edge is again pressed against the contact surface. This simple and easy adjustment of the sealing arrangement to the conditions prevailing at and in the closure, particularly to the temperature-caused deformations of the various components thereof, by directing impacts against the sealing member, is an important advantage of this particular construction of the closure and especially of the sealing arrangement thereof.

However, this proposed construction of the closure, which has metal-on-metal seal, is also unsatisfactory in some respects, particularly inasmuch as the temperature-dependent deformation of the frame and of the door changes in the course of operation of the coking oven. This is attributable to the fact that the temperatures of the various regions of the charge and thus also of the various regions of the closure continuously vary, depending on the progress of the coking operation. As a result of this, it is, for all intents and purposes, impossible to achieve a gas-tight seal of the clearance by merely advancing the sealing member in the above-discussed manner. Actually, if it was desired to assure a complete sealing during the entire coking operation or cycle, it would be necessary to continuously adjust the position of the sealing member relative to the door to thereby keep the sealing edge of the sealing member in sealing contact with the contact surface of the frame. This, however, is so time-consuming and otherwise impractical as to be incapable of realization. What has been said before is especially valid for coking ovens which have substantial height, which are being nowadays erected to an ever-increasing extent.

In order to eliminate this drawback and to achieve a long-lasting seal for closures of a different type, despite temperature-caused deformations of the frame and of the door, attempts have already been made to use, instead of the above-discussed support member which is frictionally held on the door, a sealing frame which is mounted on the door for movement toward the contact surface of the frame and which is spring-biased toward a sealing contact with the contact surface of the frame. However, even this solution to the problem of gas-tightly sealing the closure is disadvantageous in that the range within which the position of the sealing frame relative to the door can be adjusted is limited by the respective length of the biasing springs so that, under some circumstances, a complete gas-tightness is not achieved even during the original pressing of the sealing frame against the contact surface of the frame of the closure. In addition thereto, the forces which are exerted by the springs on the sealing frame are very often attenuated due to the heating of the springs during the operation of the coking oven, either during one cycle or over several cycles. Furthermore, a not insubstantial additional expenditure is involved when the sealing frame is resiliently mounted on the door. Finally, the handling of such closures requires a high degree of skill on the part of the operating personnel.

SUMMARY OF THE INVENTION

Accordingly, it is a general object of the present invention to avoid the disadvantages of the prior-art closures.

More particularly, it is an object of the present invention to design a sealing arrangement for a closure which has the advantages of the prior-art closures but which is not possessed of their drawbacks.

It is still another object of the present invention to equip a closure with a sealing arrangement including a support member which can be easily adjusted in its position for counteracting the influence of temperature-caused deformation of the frame and of the door of the closure.

It is a concomitant object of the present invention to so design the sealing arrangement that small temperature-caused deformations of the frame and the door of the closure are automatically compensated for in the sense of maintaining the gas-tightness of the closure.

A further object of the present invention is to so construct the sealing arrangement as to avoid the need for a constant adjustment of the position of the sealing arrangement relative to the door.

A yet another object of the present invention is to provide a closure, and particularly a sealing arrangement thereof, which is simple in construction, inexpensive to manufacture and reliable nevertheless.

A further object of the present invention is to so construct the closure that contamination of the sealing arrangement by volatile by-products of the coking operation is avoided to the greatest possible extent.

In pursuance of these objects and others which will become apparent hereafter, one feature of the present invention resides, briefly stated, in a sealing closure for an opening of a coking oven, which comprises a circumferentially complete frame mounted on the coking oven and bounding at least an outwardly open end of the opening; a door receivable in the opening with a clearance from the frame; means for removably holding the door in a closing position thereof with respect to the frame for closing the opening; and means for sealing the clearance, including a contact surface on the frame about the open end of the opening and with spacing therefrom, at least one sealing member including a rigid support element having a marginal portion juxtaposable with the contact surface and a sealing element of resiliently yieldable material mounted on the marginal portion of the support element, and means for connecting the support element to the door for adjustment of the position of the former relative to the latter and for retaining the support element in an adjusted position thereof in which the sealing element sealingly contacts the contact surface of the frame in the closing position of the door. Preferably, the sealing element has an elongated recess in which the marginal portion is received, and a sealing surface parallel to the recess and contacting the contact surface of the frame in the closing position of the door. Advantageously, the support element is elongated and the marginal portion thereof has longitudinally distributed projections, the sealing element having a plurality of cutouts communicating the recess with the sealing surface and adapted to accommodate the projections of the support element. To advantage, each of the cutouts has a dimension taken from the recess to the sealing surface which exceeds the corresponding dimension of the respective projection.

When the closure is constructed in the above-discussed manner, it is possible, on the one hand, to compensate for the more pronounced temperature-caused deformations of the frame and of the door, in a simple manner, by merely directing impacts against the support element which is frictionally held on the door, which results in the adjustment of the position of the support element relative to the door toward contact of the support element with the contact surface. On the other hand, the additional smaller deformations of the frame and of the door, which constantly occur during the operation of the coking oven, are compensated for by the resiliently yieldable sealing element of the sealing member, due to a resilient deformation thereof.

The automatic compensation for the small deformations of the closure during the operation of the coking oven is achieved by making the cutouts longer in direction toward the contact surface than the corresponding dimension of the respective projections of the marginal portion of the support element. In this manner, it is mainly achieved that, when the projections of the marginal portion of the support element abut against the contact surface of the frame, the sealing element is prestressed to such an extent that the pre-stressing of the sealing element and the tendency of the sealing element to reassume its unstressed configuration provide for compensating for the small deformations of the door or the frame during the coking operation, so that a gas-tight sealing effect is achieved unless the extent of the deformation of the frame or of the door or both reaches a certain limit.

However, the provision of the longitudinally distributed projections of the marginal portion of the support element also achieves additional advantages. So, for instance, these projections so connect the sealing element to the support element as to form a unitary support member therewith. This is particularly true when the projections are of dovetailed configurations as considered in the longitudinal direction of the support element. In addition thereto, these projections protect the sealing element against damage thereto or against destruction thereof, particularly during the period when impacts are directed against the support element to adjust the position thereof relative to the door and to contact the projections of the marginal portion of the support element with the contact surface of the frame. Finally, they assure, in a simple manner, a predetermined pre-stressing of the sealing element which is constant over the entire circumference of the frame and of the door.

The protection of the sealing element from damage, especially from splitting, during the period while impacts are directed against the support element, results from the fact that the projections of the marginal portion of the support element are distributed over the entire circumference of the door, so that these projections prevent the regions of the marginal portion of the support element which are situated intermediate the projections, from being displaced too close toward, or even into contact with, the contact surface of the frame. As a result of this, the sealing element cannot be damaged even if additional, actually unnecessary, impacts are directed against the support element after the projections of the marginal portion of the support element came into contact with the contact surface of the frame. In fact, such unnecessary impacts are transmitted, through the support element, and the projections thereof, directly into the frame, without having any detrimental influence on the sealing element of the sealing member and without additionally stressing the same. Thus, it is not necessary that the operating personnel exercise a high degree of care while adjusting the position of the support element inasmuch as the sealing element cannot be damaged even if a number of unnecessary impacts is directed against the support element. On the other hand, when the projections of the marginal portion of the support element come into abutment with the contact surface of the frame, this is sufficient for assuring a circumferentially constant prestressing of the sealing element.

It is advantageous for achieving a complete sealing of the clearance to make the support element and the sealing element circumferentially complete. The sealing element is particularly well connected to the support element and to the projections thereof against its unwanted disociation from the support element and the projections thereof, when the projections of the marginal portion of the support element have dovetail configurations in the longitudinal direction of the support element. Under these circumstances, the sealing element can be easily removed from the support element and the projections thereof even after a prolonged use of the sealing member, to be replaced by a new sealing element.

According to a further concept of the present invention, the frame includes an inner frame member immediately surrounding the open end of the opening, an outer frame member mounted on the inner frame member at a distance from the open end of the opening, and a heat insulation interposed between the frame members and thermally insulating the same from one another. In this construction, the contact surface is provided on the outer frame member. The reason for this construction of the frame is that, when the frame consists of two mutually thermally insulated frame members, the region of the contact surface of the frame is heated to a lesser extent during the operation of the coking oven than it would be the case in a unitary frame. As a result of this, even materials of high elasticity or resiliency can be used for the sealing element. It will be appreciated that the automatic compensation for the small deformations of the frame and of the door, and thus the sealing effect of the sealing arrangement for sealing the clearance between the door and the frame, are all the more effective, the greater the elasticity of the sealing element. The outer frame member of the frame is preferably so configurated that it has a width which only corresponds to that of the contact surface, and a thickness which is substantially smaller than that of the inner frame member. When the frame member is constructed in this manner, the heating of the frame in the region of the contact surface is further reduced.

According to a further aspect of the present invention, the sealing means may further include a sealing frame interposed between the sealing member and the open end of the opening and having a sealing portion juxtaposed with the contact surface of the frame in the closing position of the door. The sealing frame may be mounted on the door for adjustment of the position of the former relative to the latter for contacting the sealing portion with the contact surface. The sealing frame may be of a metallic material and may have a region which converges toward the sealing portion.

The sealing effect of the sealing arrangement, however, is not only influenced by the temperature-caused deformations of the frame and of the door, but also by encrustations which deposit, during the operation of the coking oven, on the sealing arrangement, and in particular also on the contact surface of the frame. These encrustations are the result of the deposition of volatile by-products of the coking operation. When such encrustations occur, they impede or prevent gas-tight contact of the sealing arrangement with the contact surface of the frame. The formation of such encrustations is attributable to the fact that the various regions of the closure are at a lower temperature than the interior of the coking oven, that is, the coking chamber and the charge contained therein, so that volatile by-products of the coking operation, such as tar or pitch vapors, condense on such relatively cool regions of the closure, especially in the lower region of the frame and of the door. The resulting liquid condensate eventually hardens and thus forms the above-discussed encrustations.

In the first-discussed prior-art closure in which the metallic sealing member is frictionally held on the door and is to be adjusted in its position by directing impacts against the same to displace it toward the contact surface of the frame, the formation of the encrustations does not constitute any significant problem inasmuch as the sealing member is rigid and thus, as it is displaced toward the contact surface of the frame, the sealing edge thereof encounters the encrustations which may be present at the contact surface of the frame and penetrates such encrustations while the impacts are directed against the sealing member so that the encrustations are, to a great extent, destroyed or removed from the contact surface of the frame at least in the region about the sealing edge of the sealing member. However, inasmuch as the support element of the present invention is pressed against the contact surface of the frame only in the regions of the projections of the marginal portion of the support element, while impacts are being directed against the support element and thus the latter is displaced toward the contact surface of the frame and into abutment therewith, the encrustations in this case, contrarily to the above-discussed case, would be destroyed during the adjustment of the deposition of the support element relative to the door only to a very limited extent. Thus, when it is desired to use the closure of the present invention without reconditioning for a multitude of coking cycles, and to assure a gas-tight sealing of the clearance between the door and the frame, that is, when it is desired to use the closure without resorting to special cleaning operations of the contact surface and of the sealing element and/or support element, it is necessary to eliminate or at least strongly suppress the formation of the encrustations in the region of the contact surface of the frame and of the sealing element. It is evident that, if it were necessary to frequently clean the contact surface of the frame and/or the sealing element in order to remove the encrustations therefrom, this would not only result in a considerable time and labor expenditure in between the coking cycles, but would also result in a significant mechanical wear and tear of the contact surface and of the sealing element. On the other hand, when the formation of the encrustations in the region of the sealing arrangement is avoided, it is necessary to replace the sealing element only after much longer periods of time than heretofore necessary.

The contact surface of the frame and the sealing element are virtually free of any encrustations thereon even after a plurality of coking cycles, when the closure has means for protecting the sealing means from deposition of volatile by-products of the coking process thereon, such protecting means including an outwardly projecting ridge on the frame in between the open end of the opening end of the contact surface of the frame. Preferably, at least a portion of the ridge has a stepped configuration, such portion advantageously extending all the way around the open end of the opening. To advantage, the contact surface of the frame is inwardly offset with respect to the respective step which has the largest magnitude. While it is not absolutely necessary to provide the frame with the ridge in all regions of the frame, it is recommended, particularly for manufacturing considerations, to provide the stepped ridge all the way around the open end of the opening of the coking oven.

When the frame of the closure is provided with such a stepped ridge, the outwardly projecting steps of the ridge constitute a significant obstruction for the condensates which are formed in the region of the open end of the opening of the frame, so that such condensates are hampered in their flow to the contact surface and to the sealing element. These obstructions constituted by the steps are especially advantageous in the regions of the longitudinal sides of the frame and of the door, where each of the edges of the various steps also constitutes a drip edge. In addition thereto, the stepped region between the frame and the door constitutes a locking and accumulating space for the condensates.

This stepped configuration of the ridge, at the lower region of the frame and of the door, especially in the region of the lower transverse sides thereof, has the result that the condensates which develop in the vicinity of the lower end of the opening of the frame can freely fall downwardly subsequent to any particular coking cycle, as well as during the following period while the door is in its open position, due to their own gravity. While so falling or dripping, the condensates will not come into contact with the contact surface underneath the lower ridge, so that the danger of deposition and hardening of such condensates on the contact surface is avoided even in this lower region. This is also true even when an airstream is directed against the coking oven from the exterior thereof, such airstream being directed against the frame of the closure.

When the sealing arrangement consists of two parts, that is, when the above-mentioned sealing frame is arranged adjacent the sealing member of the present invention and between the same and the open end of the opening of the frame, the provision of the stepped ridge between the contact surface and the outwardly open end of the opening of the frame achieves a further advantage that the inner sealing frame and the contact surface associated therewith are also not moistened by the condensates.

It is advantageous when the ridge arranged between the open end of the opening of the frame and the contact surface of the frame has at least three steps. Preferably, the ridge has four steps.

The keeping of the condensates away from the contact surface of the frame and from the sealing element is especially effective when each of the steps of the ridge which is located closer to the open end of the opening of the frame has a larger magnitude than the immediately adjacent step which is more remote from the open end of the opening. In this event, the moistening of the contact surface of the frame during and after the removal of the door following the completion of a coking cycle, is further reduced.

In order to further enhance the dripping of the condensates under the influence of gravity, it is advantageous to arrange at least one nose-shaped drip projection on the frame, such drip projection being arranged at least at the lower region of the frame in the zone adjacent to the open end of the opening, such drip projection extending substantially transversely of the ridge in the radially outward direction. It is recommended to provide such a drip projection on the step of the ridge which has the largest magnitude.

It is further advantageous when the door has a bulge which has a stepped configuration complementary to the stepped configuration of the ridge, in the region of the door which is juxtaposed with the ridge in the closing position of the door. In this manner, the frame and the door bound, in their stepped regions, a relatively narrow channel, and the steps of the door act as additional obstructions in the flow of the condensates and thus further reduce the likelihood that the condensates would reach and deposit on the contact surface of the frame or on the sealing element.

The moistening of the contact surface and of the sealing element by condensate, or the possibility thereof, is even further reduced when at least one groove is provided in the frame, extending substantially parallel to the steps of the ridge. In this construction, it is advantageous when the groove, or each groove, is provided at a side of a respective step of the ridge which is remote from the open end of the opening of the frame. Preferably, the groove extends circumferentially about the open end of the opening of the frame, and is circumferentially complete. When the door has a projecting bulge which is received in the groove of the frame in the closing position of the door, a labyrinthine seal is obtained between the door and the frame, which seal further reduces the danger of penetration of the condensates to the contact surface of the frame and the sealing element of the sealing member.

The possibility of moistening of the contact surface of the frame and of the sealing element of the sealing member by condensates is further reduced when a substantially U-shaped sheet member, extending in the circumferential direction of the frame, is interposed between the frame and the door. This sheet member or a plurality of such sheet members can entirely eliminate the danger of penetration of condensates toward the zones which are critical for the sealing of the clearance between the door and the frame.

It is advantageous when the sheet member or sheet members are removably interposed between the door and the frame. Thus, it is possible to easily exchange the sheet members when the door is in its open position, subsequent to the deposition of condensates or formation of encrustations, on the particular sheet member. It is further of advantage when the sheet member or members consist of resiliently yieldable metallic material, inasmuch as it can then be achieved that the sheet members remain in sealing contact with both components of the closure, that is the door and the frame, during the temperature-caused deformation of the frame and of the door, due to the resilient yieldability of such sheet members. Finally, it is currently preferred to provide the sheet member or members at least at the longitudinal, and at the lower transverse, regions of the door frame and the door proper.

Preferably, the sheet members are so arranged between the frame and the door that the bight of the U-shaped sheet member rests against the door, and the two arms of the sheet member abut against the frame. The shielding effect of the sheet member, preventing penetration of the condensates to the contact surface of the frame and to the sealing member, is especially pronounced when the bight of the sheet member is received in a groove of the frame, one of the arms of the sheet member resting against the frame, while the other arm of the sheet member abuts against the door.

A preferred material for the sealing element is a silicon rubber based material.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DISCUSSION OF THE PREFERRED EMBODIMENTS

Figure 1:
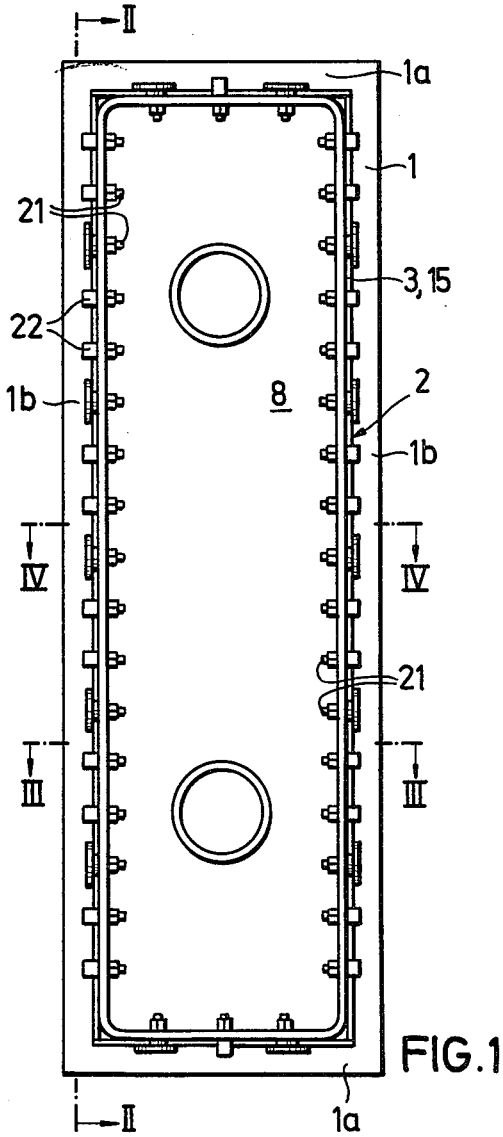
FIG. 1 is a front elevational view of a sealing closure of the present invention.
Figure 2:
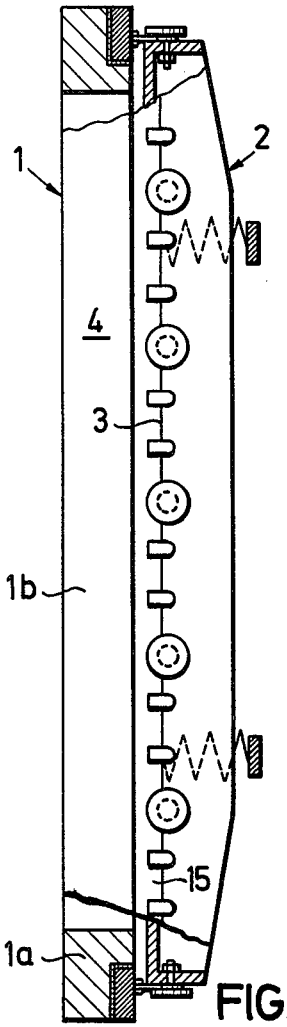
FIG. 2 is a side elevational view of the sealing closure of FIG. 1, partly sectioned on line II—II of FIG. 1.

Referring now to the drawings in detail, and first to FIGS. 1 and 2 thereof, it may be seen that they illustrate a closure to be used for closing a charging and/or discharging opening of a horizontally extending coking oven of otherwise conventional construction, which has not been illustrated in order not to unduly encumber the drawings. The closure comprises a circumferentially complete frame 1, a door 2 which can be mounted on the frame 1, and a circumferentially complete sealing arrangement designated in toto with the reference numeral 3, which is mounted on the door 2 in a manner which will be presently discussed. The frame may be, for instance, of cast iron, while the door 2 may be of grey cast iron or of a spheroidal graphite iron.

The frame 1 includes an upper and a lower transverse side, which are designated with the reference numerals 1a, as well as a pair of longitudinal sides 1b. The frame is bipartite, in that it includes an inner frame member 1α which immediately surrounds the opening 4 at the coking oven, and an outer frame member 1β which is connected to the inner frame member 1α, an insulation 5, such as asbestos plates, being interposed between the frame members 1α and 1β. Each of the frame members 1α and 1β is circumferentially complete. The outer frame member 1β, which is remote from the opening 4, has an outer region 6, which is delimited by a circumferentially complete sealing or contact surface 7. As considered in the axial direction of the opening 4, the outer frame member 1b has a thickness $a_2$ which is considerably smaller than the thickness $a_1$ of the frame 1.

The door 2 has a substantially U-shaped cross section, and it includes a door bottom 8 which covers the opening 4 of the frame 1, as well as outwardly extending door walls 9. The door bottom 8 is provided, at its side which faces toward the opening 4, with a holder 10 for a refractory, preferably masonry, material 11 which plugs the frame opening 4 in the closing position of the door 2.

Figure 3:
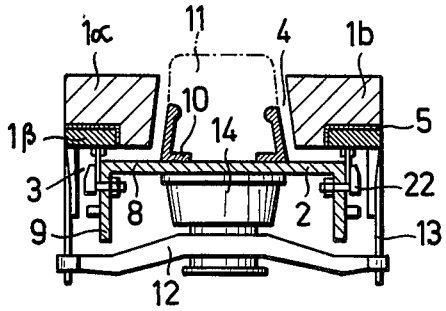
FIG. 3 is a sectional view taken on line III—III of FIG. 1.
Figure 4:
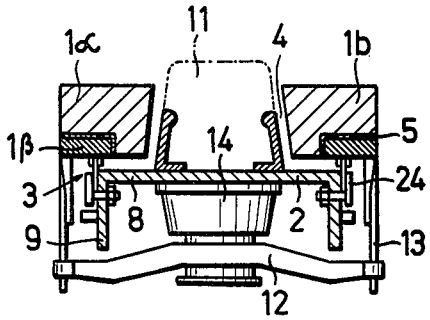
FIG. 4 is a view similar to FIG. 3 but taken on line IV—IV of FIG. 1.

The door 2 is connectable to the frame 1 by means of two holding or latching arrangements. These holding arrangements are only indicated in FIGS. 1 and 2. On the other hand, one of the holding arrangements is shown in some detail in FIGS. 3 and 4. Each holding arrangement includes a pivotable latch 12 which cooperates with and can be resiliently pressed against detent members 13 connected to the frame 1 at the sides thereof, a pressure-responsive device 14 of a conventional construction acting on the latching element 12.

Figure 5:
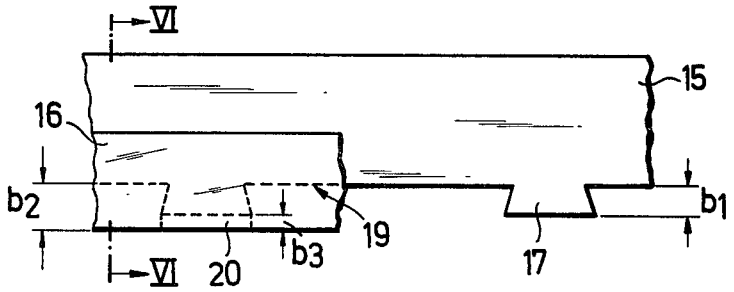
FIG. 5 is a fragmentary side elevational view of a sealing arrangement of the closure of FIG. 1, in unstressed condition.
Figure 6:
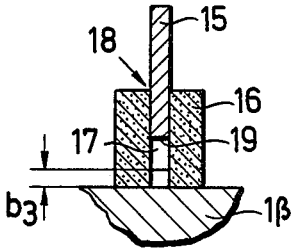
FIG. 6 is a sectional view taken on line VI—VI of FIG. 5.

The sealing arrangement 3 includes a metallic support element 15 which circumferentially surrounds a portion of the door 2, the support element 15 being movable relative to the door 2 in direction toward the frame 1. The sealing arrangement 3 further includes a sealing element 16, such as a sealing rope, of elastic material, which is also circumferentially complete and which can be pressed against the sealing or contact surface 7 of the frame 1. As particularly seen in FIGS. 5 to 7, the support element 15 is provided, at its marginal portion which extends toward the frame 1 and beyond the door 2, with a number of projections 17 which are distributed longitudinally of the support element 15 about the circumference of the door 2, and which extend beyond the remainder of the support element 15 toward the contact surface 7 of the frame 1 in the closing position of the door 2. As illustrated in FIG. 5, the projections 17 have dovetail configurations as considered in the longitudinal direction of the support element 15.

The sealing element 16 has a circumferentially complete elongated recess 18. Cutouts 20 are provided at the bottom surface of the recess 18 of the sealing element 16, the length $b_2$ of each particular cutout 20 exceeding the corresponding dimension $b_1$ of the respective projection 17. The marginal portion of the support element 15, which is equipped with the projections 17, is accommodated in the elongated recess 18 of the sealing element 16, while the projections 17 are clampingly received within the cutouts 20 of the sealing element 16.

The support element 15 is frictionally retained on the door 2 in the region of the walls 9 of the latter. In order to frictionally hold the support element 15 on the walls 9, there are provided bores in the walls 9, screws 21 or similar holding components being accommodated in such bores. A hook member 22 is mounted on one end of the shaft of some of the screws 21, while a cam plate 23, a clamping plate 24 and an adjusting head 25 are mounted at the respective ends of the remaining screws 21. Thus, the support element 15 is pressed against the walls 9 in the regions of the respective screws 21, either by one of the hooks 22 or by a clamping plate 24. The circumference of each cam plate 23 has the shape of a section of a spiral having an axis which coincides with that of the associated screw 21.

Figure 7:
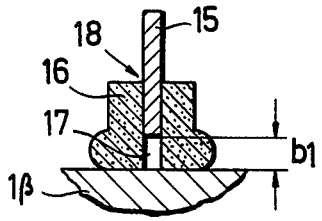
FIG. 7 is a view similar to FIG. 6 but in stressed condition.
Figure 8:
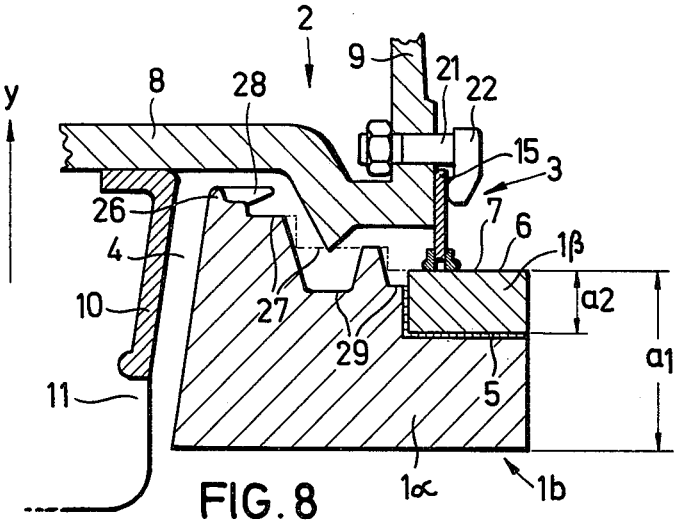
FIG. 8 is an enlarged sectional view of a detail of FIGS. 3 and 4.

Now, when the door 2 is mounted on the frame 1 and arrested in its closing position prior to the beginning of the coking operation, the sealing element 16 is sealingly pressed against the contact surface 7 of the frame 1, substantially as illustrated in FIG. 7. To achieve this sealing contact of the sealing element 16 with the contact surface 7 of the frame 1, impacts or blows are directed against the rear portion of the support element 15 which faces away from the frame 1, as a result of which the support element 15 is advanced in direction toward the contact surface 7 of the frame 1, together with the sealing element 16. The impacting of the support element 15 is continued at least until the projections 17 abut against the contact surface 7 of the frame 1. In this condition, the sealing element 16 is compressed and thus pre-stressed, the compression and pre-stressing of the sealing element 16 being uniform over the entire circumference of the sealing arrangement 3.

Figure 11:
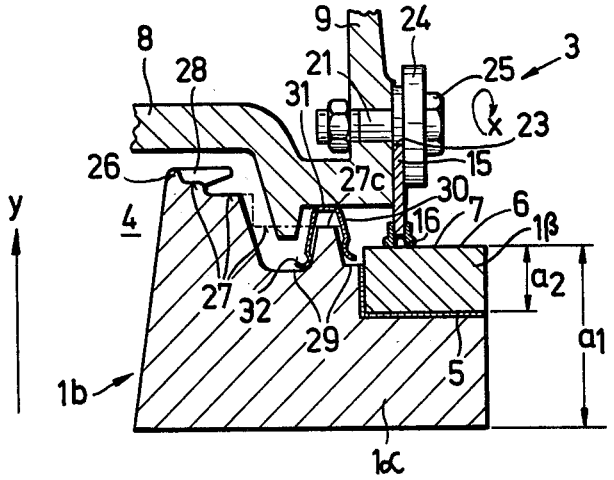
FIG. 11 is a view similar to FIG. 9 but having still another sheet member.

During the operation of the coking oven, that is, during the coking cycle, either the frame 1 or the door 2 or both suffer deformations which result from the temperature changes, that is, increases or decreases, which take place while a charge is being coked in the interior of the coking oven. When these deformations are relatively small, they will be compensated for by the tendency of the sealing element 16 to reassume its original, uncompressed configuration. More particularly, due to the pre-stressing of the sealing element 16, the latter will remain in a sealing contact with the contact surface 7 of the frame 1 so long as the distance between the door 2 and the frame 1 at any particular location is smaller than the distance $b_3$, the distance $b_3$ being equal to the difference between the dimensions $b_2$ and $b_1$ of the cutouts 20 and the projections 17, respectively. On the other hand, when the temperature-caused deformations of the frame 1 or the door 2 are greater than that, that is, should the distance between the frame 1 and the door 2 increase by more than the dimension $b_3$, the sealing effect of the sealing arrangement 3 can be restored by advancing the support element 15, by directing blows against the same, toward the contact surface 7 of the frame 1. Prior to the commencement of the coking operation, and subsequent to the connecting and arresting of the door 2 in the frame 1 the peripheral surface of the cam plate or disc 23 was in contact with the rear part of the support element 15. Now, when the additional blows have been directed against the rear portion of the support element 15, the latter has moved away from the peripheral surface of the cam plate 23. In order to restore the contact of the cam plate 23 with the support element 15, to arrest the same in the particular adjusted position thereof, the adjusting head 25 is rotated until the peripheral surface of the cam plate 23 again contacts the rear portion of the support element 15. The corresponding direction of rotation of the adjusting head 25 is illustrated in FIG. 11 by an arrow X.

In the basic arrangement of the present invention which is illustrated in FIGS. 1 through 4, the inner frame member 1α of the frame 1 is flat at its side which faces outwardly of the coking oven. On the other hand, the inner frame member 1α of the modification of the basic concept of the present invention illustrated in particular in FIGS. 8 to 12, has a stepped configuration, that is, it has a ridge which circumferentially surrounds the opening 4 of the frame 1, the ridge being situated between the open end of the opening 4 of the frame 1 and the contact surface 7. The ridge is composed of a plurality of steps of different magnitudes as considered in the direction of the axis Y of the opening 4. Thus, the frame 1 is configurated as a stepped frame, so that the frame 1 and the door 2 bound a condensate blocking and accumulating space in the region of stepped configuration of the frame 1. In the embodiments of FIGS. 8 to 12, the contact surface 7 is inwardly offset from the step 26 of the frame 1 which immediately surrounds the frame opening 4 and which is of the greatest magnitude. In other words, the step 26 extends outwardly beyond the plane defined by the contact surface 7 of the frame 1.

The frame 1, which is constructed as a stepped frame, as illustrated in FIGS. 8 through 12, has, for instance, four steps 27 on the ridge between the opening 4 and the contact surface 7, the configuration of the various steps 27 being indicated in the drawing by dash-dotted lines. The ridge is stepped in such a manner that always a step 27 which is closer to the opening 4 of the frame 1 is of a greater magnitude than an outwardly adjacent step 27.

As also illustrated in FIGS. 8 to 12, the frame 1 is equipped, at the region of the lower transverse side 1a and of the lower part of the longitudinal sides 1b, in the zone of the opening 4, with a nose-shaped projection 28 which extends transversely to the axis Y of the opening 4 and laterally outwardly, the projection 28 constituting a drip region. The projection 28 is preferably provided, as illustrated, on the step 26 of the frame 1 which is arranged immediately around the opening 4 of the frame 1 and which is of the greatest magnitude of all of the steps 26, 27.

It may be also seen in FIGS. 8 to 12 that the bottom 8 of the door 2 may also be stepped in the region which is juxtaposed with the stepped region of the frame 1, basically in the same sense as, that is, complementarily to, the stepped region of the frame 1. Thus, the distance between the frame 1 and the door 2, that is, the width of the clearance between the frame 1 and the door 2, is virtually constant.

The frame 1 is further provided, in its stepped region between the open end of the opening 4 and the contact surface 7 of the frame 1, with two grooves 29 each of which extends parallel to the edges 27a of the steps 27 of the ridge. As illustrated, the grooves 29 are arranged at those ends of the two steps 27 which are closest to the contact surface 7, that are more remote from the region of the opening 4 of the frame 1. Preferably, the grooves 29 extend all the way around the opening 4 of the frame 1. Furthermore, the door 2 may have a bulge, which is also illustrated in the drawings, which bulge is received in the groove 29 which is closer to the opening 4 of the frame 1, to form a labyrinthine passage therein.

Figure 9:
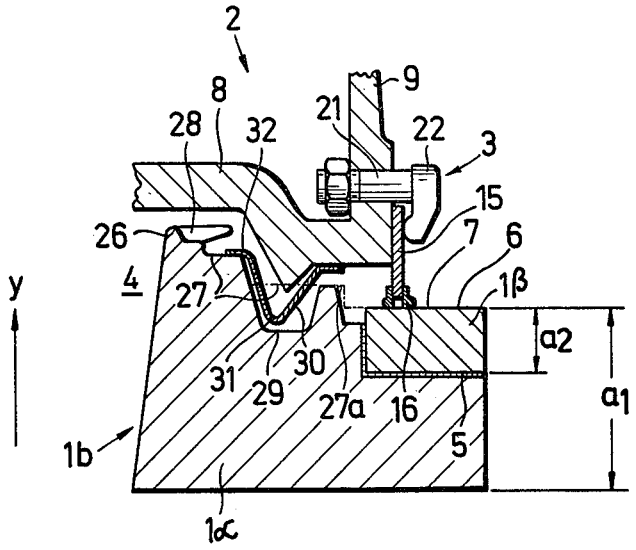
FIG. 9 is a view similar to FIG. 8 and illustrating a sheet member arranged within the closure of FIG. 1.
Figure 10:
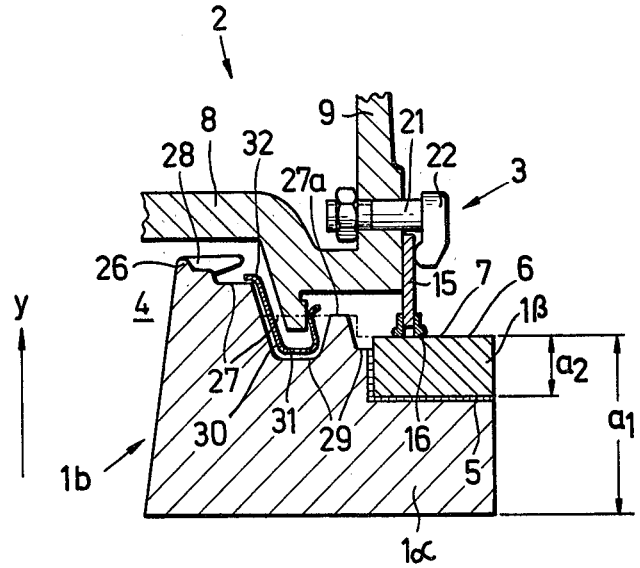
FIG. 10 is a view similar to FIG. 9 but having a different sheet member.

In the modifications illustrated in FIGS. 9, 10 an 11, sheet members 30 of springy material are removably interposed in the stepped region of the clearance between the frame 1 and the door 2. Each of the sheet members 30 is elongated and substantially U-shaped in cross section. The sheet members 30 are arranged at least at the longitudinal sides 1b and the lower transverse side 1a of the frame 1.

In the embodiments illustrated in FIGS. 9 and 10 a bight 31 of the respective sheet member 30 is accommodated in the groove 29 which is closest to the opening 4 of the frame 1, one of the arms 32 of the respective sheet member 30 abutting against the frame 1, while the other arm 32 rests against the door 2. In the arrangement illustrated in FIG. 9, the other arm 32 rests against a part of the bottom 8 of the door which extends transversely of the axis Y of the opening 4, so that it exerts forces directed parallel to the axis Y. On the other hand, in the arrangement of FIG. 10, the other arm 32 of the sheet member 30 rests against a part of the bottom 8 of the door 2 which extends parallel to the axis Y of the opening 4, so that it exerts a force directed transversely of the axis Y. In the arrangement illustrated in FIG. 11, the bight 31 of the sheet member 30 abuts against the bottom 8 of the door 2, and the arms 32 rest against the frame 1. In this arrangement, the arms 32 extends substantially parallel to the direction of the axis Y, while the bight 31 extends transversely to the axis Y of the opening 4.

Figure 12:
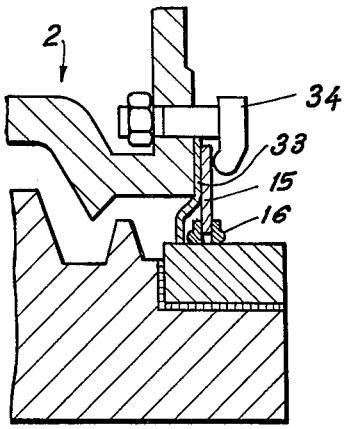
FIG. 12 is a view similar to FIG. 8 and illustrating a sealing frame.

FIG. 12 illustrates that a sealing frame 33 may also be supported on the door 2, extending into the clearance between the door and the frame 1 between the sealing member 15, 16 and the opening 4. The sealing frame 33 is held on the door 2 by a conventional holding means 34. The sealing frame 33 contacts the contact surface 7 of the frame 1 in the closing position of the door 2 and thus shields the sealing member 15, 16 from detrimental influences of condensates which may penetrate, especially when still in vapor form, through the clearance between the frame 1 and the door 2.

It will be understood that each of the elements described above, or two or more together, may also find a useful application in other types of constructions differing from the types described above.

While the invention has been illustrated and described as embodied in a sealing closure for an opening of a coking oven, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A closure for an opening of a coking oven, comprising a circumferentially complete frame mounted on the coking oven, bounding at least an outwardly open end of the opening and having a contact surface surrounding the open end of the opening with a spacing therefrom; a door receivable in the opening with a clearance from said frame; means for removably holding said door in a closing position thereof with respect to said frame for closing the opening; means for sealing said clearance, including at least one sealing member which includes an elongated rigid support element having a marginal portion juxtaposable with said contact surface and having longitudinally distributed projections, and a sealing element of resiliently yieldable material having an elongated recess in which said marginal portion of said support element is received to mount said sealing element on said support element, a sealing surface parallel to said recess and juxtaposable with said contact surface of said frame, and a plurality of cutouts communicating said recess with said sealing surface and adapted to accommodate said projections of said support element; and means for connecting said support element to said door for an adjustment of the position of said support element relative to said door and for retaining said support element in an adjusted position thereof relative to said door in which said sealing surface of said sealing element sealingly contacts said contact surface of said frame in said closing position of said door.

2. A closure as defined in claim 1, wherein each of said cutouts has a dimension taken from said recess to said sealing surface which exceeds the corresponding dimension of the respective projection.

3. A closure as defined in claim 1, wherein each of said projections has a dovetail shape as considered in the longitudinal direction of said support element.

4. A closure as defined in claim 1, wherein said sealing member circumferentially completely surrounds the open end of the opening.

5. A closure as defined in claim 1, wherein said sealing element is of a silicon-rubber-based material.

6. A closure as defined in claim 1, wherein said frame includes an inner frame member immediately surrounding the open end of the opening, an outer frame member mounted on said inner frame member at a distance from the open end of the opening, and a heat insulation interposed between said frame members and thermally insulating the same from one another; and wherein said contact surface is provided on said outer frame member.

7. A closure as defined in claim 6, wherein said outer frame member has a width which corresponds to that of said contact surface, and a thickness which is substantially smaller than that of the inner frame member.

8. A closure as defined in claim 1, wherein said sealing means further includes a sealing frame interposed between said sealing member and the open end of the opening and having a sealing portion juxtaposed with said contact surface of said frame in said closing position of said door.

9. A closure as defined in claim 8, wherein said sealing frame is mounted on said door for an adjustment of the position of said sealing frame relative to said door for contacting said sealing portion with said contact surface.

10. A closure as defined in claim 1; and further comprising means for protecting said sealing means from deposition of volatile by-products of the coking process thereon, including an outwardly projecting ridge on said frame in between the open end of the opening and said contact surface of said frame.

11. A closure as defined in claim 10, wherein said ridge has at least three steps of different magnitudes.

12. A closure as defined in claim 10, wherein said ridge has at least four steps of different magnitudes.

13. A closure as defined in claim 10, wherein said ridge has at least a portion which has a stepped configuration.

14. A closure as defined in claim 13, wherein said portion of said ridge extends all the way around the periphery of the opening.

15. A closure as defined in claim 10, wherein said ridge has a plurality of steps of gradually decreasing magnitudes as considered from the open end of the opening to said contact surface.

16. A closure as defined in claim 15, wherein said contact surface of said frame is inwardly offset with respect to the respective step which has the largest magnitude.

17. A closure as defined in claim 15, wherein said door has regions which are juxtaposed with said ridge in said closing position, said regions having stepped configurations which are substantially complementary to those of said steps of said ridge.

18. A closure as defined in claim 15; and further comprising at least one drip projection on said ridge.

19. A closure as defined in claim 18, wherein said drip projection is provided on the respective step of said plurality which has the largest magnitude.

20. A closure as defined in claim 18, wherein said drip projection extends from said ridge in direction toward said contact surface of said frame.

21. A closure as defined in claim 15, wherein said frame has at least one groove between the open end of the opening and said contact surface of said frame, said groove extending substantially parallel to said steps of said ridge.

22. A closure as defined in claim 21, wherein said groove is situated at a side of a respective step which is distant from the open end of the opening.

23. A closure as defined in claim 21, wherein said groove extends circumferentially about the open end of the opening.

24. A closure as defined in claim 21, wherein said door has a projecting bulge extending into said groove in said closing position of said door and defining a labyrinthine passage therewith.

25. A closure as defined in claim 15; and further comprising at least one sheet member of substantially U-shaped configuration interposable between said door and said frame in the region of said plurality of steps to extend in the circumferential direction of said ridge.

26. A closure as defined in claim 25, wherein said sheet member is removably interposable between said door and said frame.

27. A closure as defined in claim 25, wherein said sheet member is of a resiliently yieldable material.

28. A closure as defined in claim 25, wherein said sheet member has two arms and a bight interconnecting said arms; and wherein said bight rests against said door and said arms abut said frame in said closing position.

29. A closure as defined in claim 25, wherein said sheet member has two arms and a bight interconnecting said arms; wherein said frame is provided with a groove; and wherein said bight is received in said groove of said frame, one of said arms abuts against said frame and the other arm rests against said door, in said closing position.

30. A closure as defined in claim 25, wherein said frame and said door have respective lateral, lower, and upper portions; and wherein said sheet member is interposable between said door and said frame at least in the region of said lateral and lower portions.

* * * * *